US005511884A

United States Patent [19]

Bruno et al.

[11] Patent Number: 5,511,884

[45] Date of Patent: Apr. 30, 1996

[54] RECLOSEABLE PLASTIC BAG WITH EASY OPEN AND EASY RECLOSE PROFILES

[76] Inventors: Edward C. Bruno, 15336 Penwood Pl., Aurora, Colo. 80015; Roger A. Davison, 8761 Galen Ct., Denver, Colo. 80229

[21] Appl. No.: 349,196

[22] Filed: Dec. 5, 1994

[51] Int. Cl.[6] ..... B65D 33/01; B65D 33/24

[52] U.S. Cl. ..... 383/63; 24/587; 383/100; 493/214

[58] Field of Search ..... 383/63, 64, 65, 383/100, 9; 24/587; 493/214

[56] References Cited

U.S. PATENT DOCUMENTS

| | | | |
|---|---|---|---|
| Re. 34,347 | 8/1993 | Van Erden et al. | 383/63 |
| 3,790,992 | 2/1974 | Herz | 383/64 |
| 3,986,914 | 10/1976 | Howard | 493/214 |
| 4,358,466 | 11/1982 | Stevenson | 383/100 |
| 4,589,145 | 5/1986 | Van Erden | 383/63 |
| 4,654,878 | 3/1987 | Lems | 383/65 |
| 4,846,586 | 7/1989 | Bruno | 383/9 |
| 4,929,225 | 5/1990 | Ausnit et al. | 493/214 |
| 5,334,127 | 8/1994 | Bruno et al. | 493/214 |

FOREIGN PATENT DOCUMENTS

| | | | |
|---|---|---|---|
| 0240650 | 10/1991 | Japan | 383/63 |

*Primary Examiner*—Stephen P. Garbe
*Attorney, Agent, or Firm*—Leo J. Aubel

[57] ABSTRACT

A recloseable plastic bag having male and female interlocking profiles which are easily openable and easily closeable, and a method of making such bag are disclosed. The bag includes mating profiles which comprise a selected non-engaging section such that the profiles cannot interlock at that section. The non-engaging section permits a user to more easily open the bag when the separating action of the profiles is initiated at the non-engaging section. The non-engaging section also permits air to escape as the bag and profiles are pressed together to close, to enable easier closing of the bag when product is contained therein.

7 Claims, 4 Drawing Sheets

RECLOSEABLE PLASTIC BAG WITH EASY OPEN AND EASY RECLOSE PROFILES

BACKGROUND OF THE INVENTION

Recloseable (re-closeable) plastic bags are well known in the art. It is known in the prior art to provide a thin sheet of tubular stock material which includes mating profiles. The tube and profiles are then sealed and severed to form bags. The profiles are positioned along the mouths of the bags and can be repeatedly opened and closed by the user as desired.

The prior art comprises many patents that disclose recloseable plastic bags which include mating profiles designed to open and close repeatedly. It has been found that prior art bags can be opened by a user and satisfactorily hold a product, but prior art bags prove to be difficult to reclose (re-close) since the profiles are cumbersome to align and engage. Also, the prior art bags tend to balloon-out when they are being reclosed. This is due to the fact air is captured when the bag is opened, and the air is retained within the bag as the profiles are pressed together to close (reclose) or engage. The problem of reclosing of the bags is made more cumbersome when the bags are, for example, placed in a freezer with their contents. When a bag is taken out of the freezer and opened, and it is desired to reclose the bag, the extremes in temperature to which the profiles are subjected make the profiles quite rigid, and make the aligning and mating of the profiles awkward.

SUMMARY OF THE INVENTION

The present invention discloses a recloseable plastic bag having mating profiles which are specifically made with a section of the profiles which is in a non-engageable condition, and hence the profiles do not engage to lock in this section and do not close and do not to seal the mouth of the bag in this section. The invention also discloses an improved method of making plastic bags with profiles which have a re-formed section.

The foregoing features and advantages of the present invention will be apparent from the following more particular description of the invention. The accompanying drawings listed hereinbelow, are useful in explaining the invention.

DRAWINGS

DESCRIPTION OF THE INVENTION

Recloseable plastic bags made in accordance with the prior art such as shown in U.S. Pat. No. Re. 29,208 have their mating profiles engaged, and the bags are made with their mouths being closed. In contrast to the prior art, the present invention makes the recloseable plastic bags 11 with a mouth which is partially open. As will be explained in detail, the mating profiles are made to be disengaged or unlocked along a section of the profiles, and, even when the profiles are engaged, the mouth of the bags 11 is not fully closed. It should be readily be appreciated that the inventive bags are not intended for containing fluids or other flowable materials since the mouth of the bag is open, that is, it is not fully sealed by the profiles.

Figure 1:
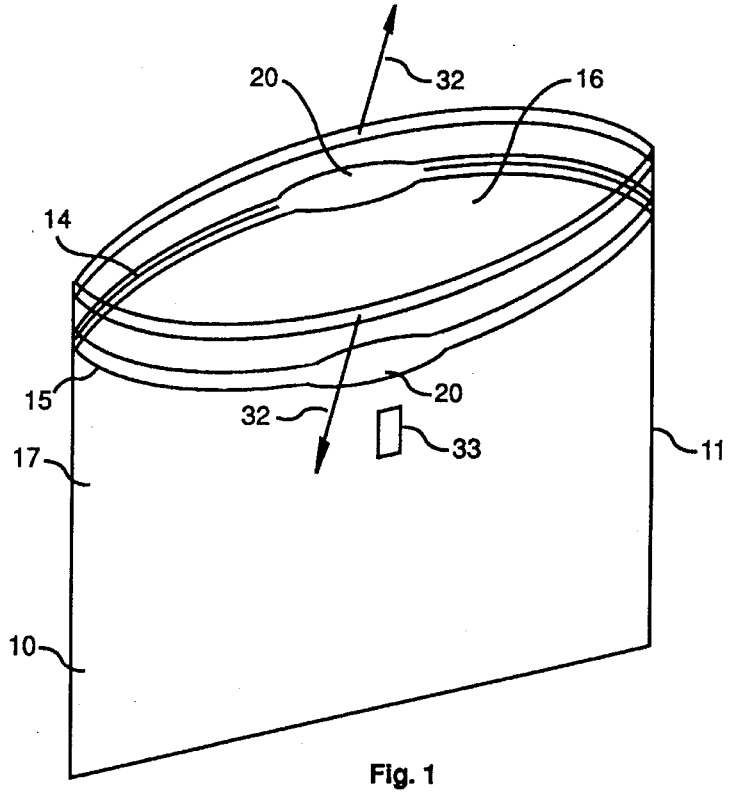
FIG. 1 is a view of a recloseable bag including engaging profiles embodying the present invention.

Easy open and easy close bags 11 of the invention are shown in FIG. 1. The bags 11 are made of plastic sheet material 10 (see also FIG. 4) with mating, engaging or interlocking profiles 14 and 15 which may be formed integrally with the sides 16 and 17 of the bags. Note, that the profile 14 is made to have a symmetrical arrowhead; that is, the two barbs of the arrowhead are substantially identical, and this provides a very positive and strong mating engagement of the profiles 14 and 15 to resist the unlocking or opening of the profiles.

Importantly, the inventive bags 11 are configured or made with an non-engageable section, generally labeled 20, in the profiles 14 and 15. Non-engageable section 20 will be described in more detail hereinbelow.

Figure 2:
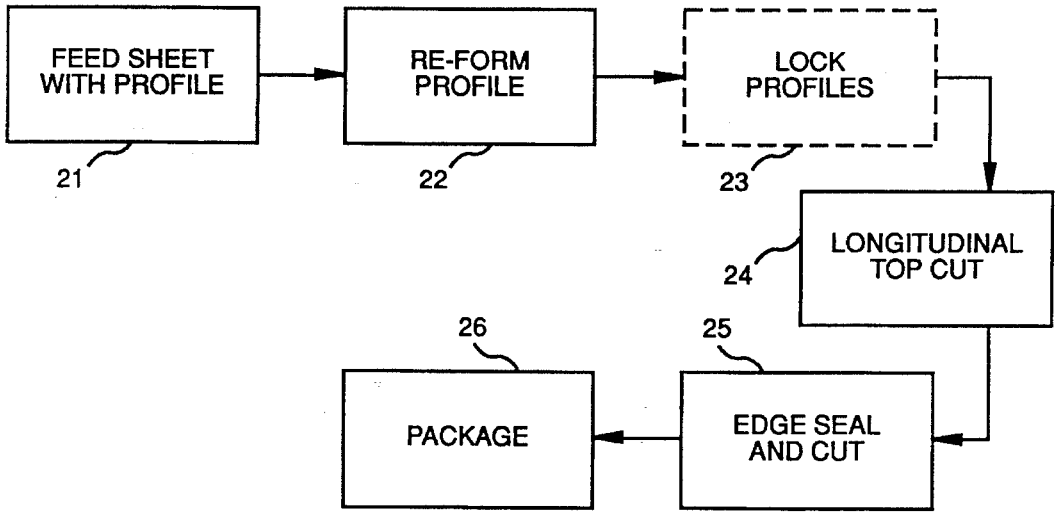
FIG. 2 depicts steps in the method of making bags in accordance with the invention.
Figure 3:
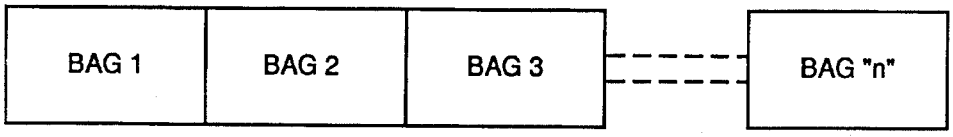
FIG. 3 depicts a series of bags formed by the method of FIG. 2.
Figure 4:
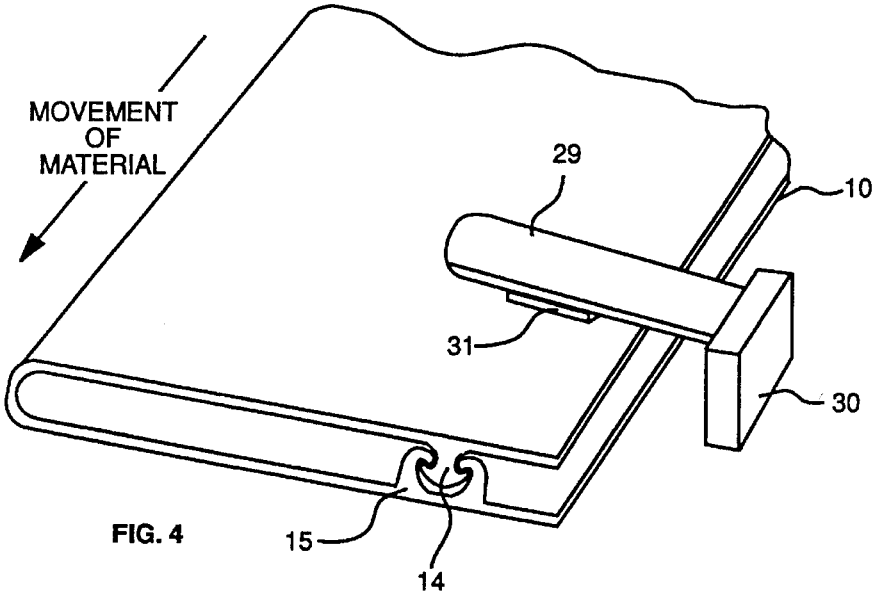
FIG. 4 is a view depicts the apparatus and method for re-forming of the profiles of the bag in accordance with the present invention.
Figure 10:
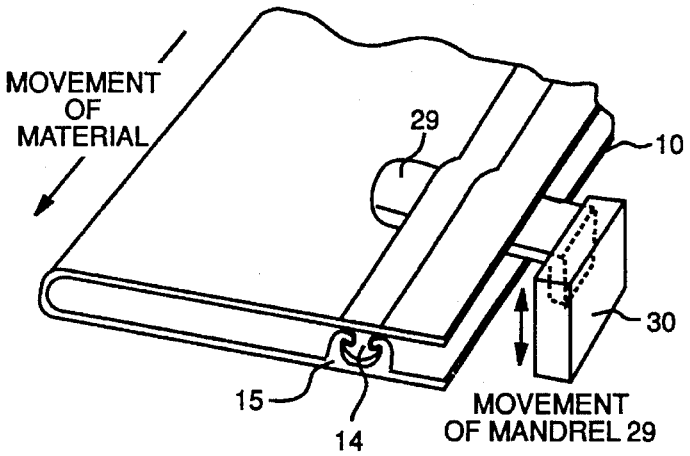
FIG. 10 shows an apparatus and method for making a second embodiment of the invention wherein only one of the profiles is re-formed.
Figure 11:
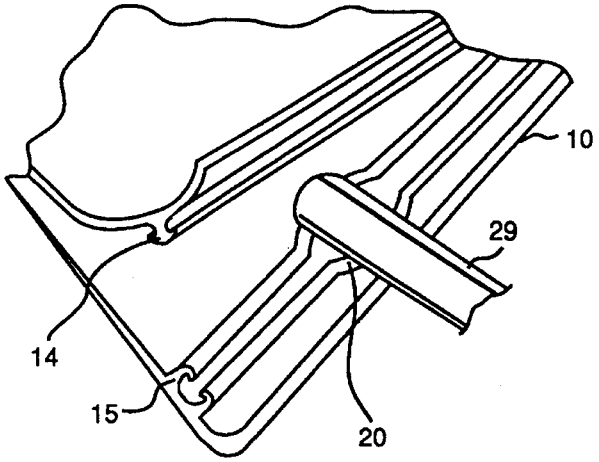
FIG. 11 shows, in relatively enlarged isometric view, the re-forming of the profiles of FIG. 10.

Refer now to FIG. 2, which shows a block diagram useful in explaining a preferred method of making the easy open and easy close bags 11 of the invention. FIG. 2 depicts the well known process of feeding a continuous plastic tubular sheet material 10 with male and female mating profiles 14 and 15 formed integrally thereon, or affixed as by heat sealing to the plastic material 10, to a bag making machine. The first step is indicated at box 21. In the preferred embodiment, a re-forming profile step, indicated at box 22, is provided to re-form the profiles 14 and 15. The manufacturing steps depicted in respective boxes 24, 25 and 26 are standard well known steps presently used to make bags from the incoming sheet material 10 to form a series of bags as indicated in FIG. 4. Box 23 is shown in dotted lines since the step of locking the profiles is used only for the second embodiment of the invention as indicated in FIGS. 10 and 11 where only one of the profiles is re-formed, and it is necessary to close the profiles after reclosing. The embodiment of FIGS. 10 and 11 will be described more fully below.

It should be appreciated that while in a preferred method of the invention the re-forming action shown in FIG. 2 is effected at the beginning of the bag making process the re-forming action could be effected essentially any time during the bag making process.

As alluded to above, the mating profiles 14 and 15 for the recloseable plastic bags are most often made or extruded integrally with the sheet material 10; however, mating profiles are also sometimes made separately, or are formed on strips of plastic. The separately formed profiles and the profiles formed on strips are subsequently affixed to the sheets such as by heat sealing. As is evident, the inventive bag and method of making the easy open and easy close bags 11 of the invention are equally useful whether the engaging or mating profiles are extruded concurrently with the tubular bag material 10 or whether they are subsequently affixed thereto.

Refer now also to FIGS. 4–7. In accordance with the invention, in the bag making process, the flattened sheet material 10 and the closed profiles 14 and 15 are fed essentially as a continuous sheet as indicated in FIG. 2 to a rod or mandrel 29 which is positioned over the sheet material 10 and profiles 14 and 15. In the preferred embodiment, the mandrel 29 is controlled such as by an electrical control 30, of any suitable known design, to be operable in a periodic reciprocating motion to press down against the profiles 14 and 15 to re-form, flatten and cause the profiles to open in section or area 20. Electrical control 30 is desirably timed to press down on the profiles 14 and 15 at a section or area 20 which may conveniently be the center or middle of each of bags 11 being made. The location of section 20 is, however, not critical.

Figure 5:
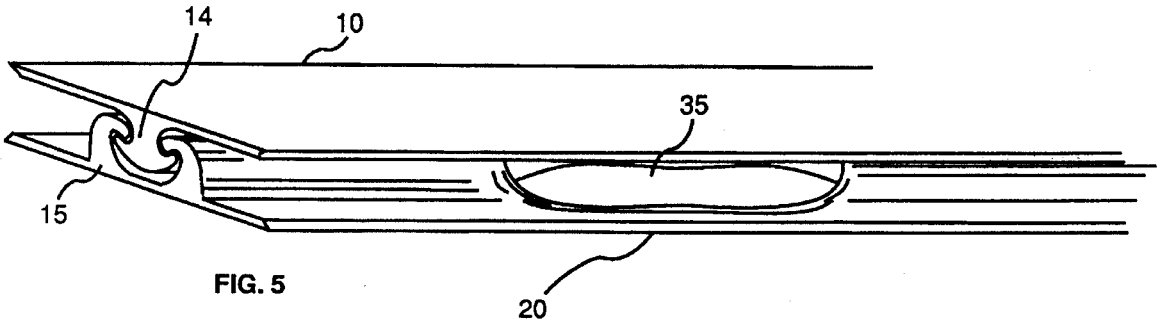
FIG. 5 is a relatively enlarged view showing the non-engaging section of the profiles in accordance with the invention.
Figure 6:
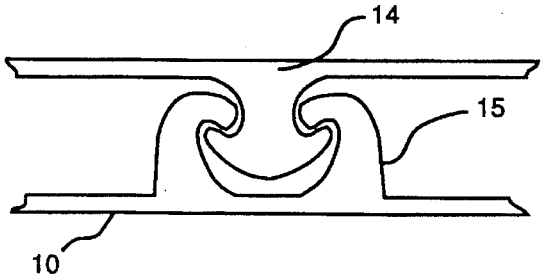
FIG. 6 is an enlarged cross section of the mating profiles of the inventive bag of FIG. 1.
Figure 7:
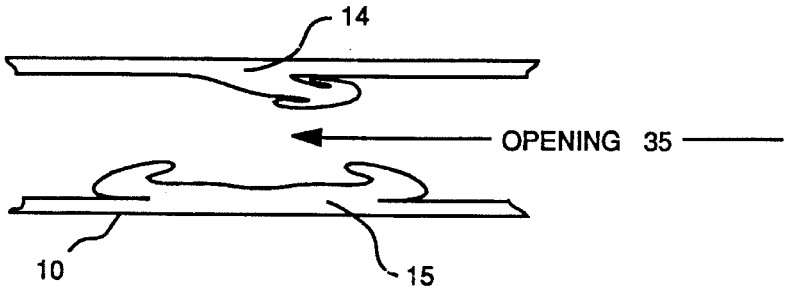
FIG. 7 is a cross section of the re-formed, non-engaging section of the profiles of FIG. 6.

Mandrel 29 re-forms, flattens or opens profiles 14 and 15 sufficiently to cause the section 20 of the male and female profiles 14 and 15 to totally disengage, as depicted in FIGS. 5 and 7. FIG. 6 depicts the profiles 14 and 15 in their normal engaged or interlocked mode. FIGS. 5 and 7 depicts the profiles 14 and 15 after section 20 has been re-formed by the pressure of mandrel 29. As can be clearly seen, the profiles 14 and 15 no longer engage or interlock in section 20. As depicted in FIG. 5 and 7, in enlarged exaggerated format, there is an opening 35 formed in the section 20. The reforming of section 20 thus provides a section where the two sides 15 and 16 of bag 11 and the profiles may abut or abut each other but do not engage. The mouth of bag 11 is thus unlocked or open at section 20, and mouth of bag 11 is always partially open at opening 35.

Because of the re-forming, flattening and opening of the profiles 14 and 15; there will be no engagement, mating or gripping of the female profile to the male profile 14 at section or area 20. Accordingly, a user may open the bags 11 by initiating a separating or bag opening force to separate the profiles 14 and 15 apart adjacent section 20, as indicated by the arrows 32 in FIG. 1. The "pre-opened" section 20 enables the profiles to be separated more easily at that point.

An important advantage of the invention is that thin gauge plastic sheet material such as of, one and a quarter mil (1 and ¼) thickness, can be used in making the inventive bags 11. Because the non-engaging section 20 of the profiles 14 and 15 enables the profiles to be more easily opened, the action of opening the bag 11 does not tear or damage the thin material from which the bag can be made.

Other means of making the non-engaging section 20 can be utilized such as cutting away one or both of the profiles 14 and 15 at section 20. Also, the profiles 14 and/or 15 could be extruded with a section 20 being periodically extruded which section has no engaging profiles. However, the preferred method is effective and convenient to implement.

More than one section 20 can be made for each bag, however one section 20 in the center or middle of the bags 11 has been found to be preferred for purposes of ease of opening and ease of closing of most bags. A mark or indicia 33 (FIG. 1) such as a rectangle or such as a small arrowhead can be provided to designate the section or area 20 at which the easy opening activation may be initiated or started. A marker 31 (see FIG. 4) of any suitable known design is conveniently mounted on mandrel 29 to make a mark on the bags 11 each time the mandrel presses down on the sides of the bags re-form the profiles.

Note that section or area 20 is a relatively limited section of the overall length of the profiles 14 and 15. While the exact dimensions of section 20 are not critical, in the preferred embodiment of the invention, section 20 is between one-half inch to one inch long, and the engaging or gripping length of the profiles 14 and 15 remains effective along the major portion of the mouth of the bag 11. Hence the engaging or gripping feature of the profiles 14 and 15 remains substantial. Further, the invention is not limited to bags of any particularly size.

As disclosed in the prior art such as U.S. Pat. No. Re. 29,208 cited above, one form of the male mating profile comprises a non-symmetrical arrowhead with a shortened or rounded member which engages a "C" shaped female profile. Even though the shortened member or rounded member does not provide as secure an engagement, it does allow the profiles to be more easily pulled apart for opening the bag. In contrast to the prior art, the arrowhead of the male profile 14 can have symmetrical barbs to strongly engage the female profile to hold the mouth of the bag closed, and yet the profiles can be easily separated by engaging, that is grasping, the profiles 14 and 15 adjacent the section 20 and pulling the profiles apart as indicated by the line arrows 32 in FIG. 1.

Importantly in the process of reclosing the bag 11, the user aligns the profiles 14 and 15 and presses them together to effect engagement of the profiles. Any air that has been captured within the bag is expelled through the non-sealing or open section 20 as the bag 11 and the profiles 14 and 15 are pressed together to reclose the bag. Reclosing of the bag 11 can be effected quickly, and reclosing is no longer a "hassle". This has been found to be very handy for closing bags which, for example, have been in a freezer with product in the bag, some of the product is removed and the bag has to be reclosed and replaced in the freezer. As much of the air from within the bag should be removed during reclosing of the bag, and section 20 and opening 35 very effectively to permit air to be forced out therethrough.

Figure 8:
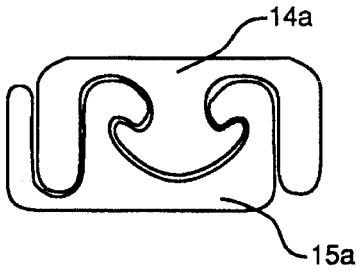
FIG. 8 is an enlarged cross section of a second type of mating profiles useful with the inventive bag.
Figure 9:
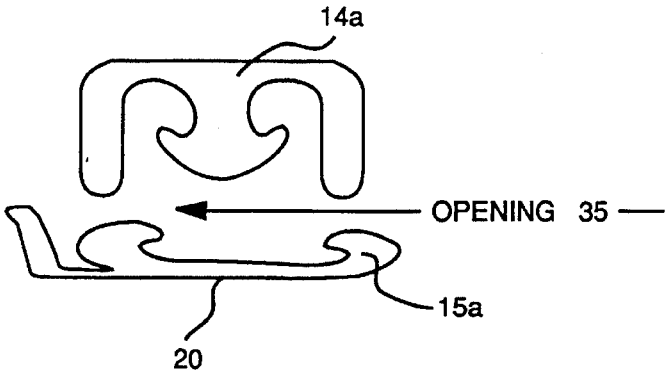
FIG. 9 is a cross section of the re-formed, non-engaging profiles of FIG. 8.

Refer to FIGS. 8 and 9 which show "m" shaped mating profiles 14A and 15A which may be used in bags 11. In a manner similarly to that described above, such profiles can be re-formed to provide a non-engaging section 20. FIG. 8 shows the profiles 14A and 15A in an engaged interlocked mode, and FIG. 9 shows the profiles 14A and 15A in the re-formed, non-engaging section 20.

Refer now to FIGS. 10 and 11 which show a modification of the invention wherein only the female profile 15 is re-formed by mandrel 29. In this embodiment the mandrel 29 is positioned between the profiles 14 and 15 and, as shown, only the female profile 15 is re-formed to a widened or open condition. As mentioned above, in the bag making process of this embodiment, after the profile 15 is re-formed, the profiles are closed by any suitable known means depicted by the box 23, shown in dotted lines in FIG. 2. As also mentioned above, the step of box 23 is used when only one profile is re-formed, as described. In this modification, the sheet of material 10 is similarly fed through the other bag making steps to complete the bags 11, as is well known.

Figure 12:
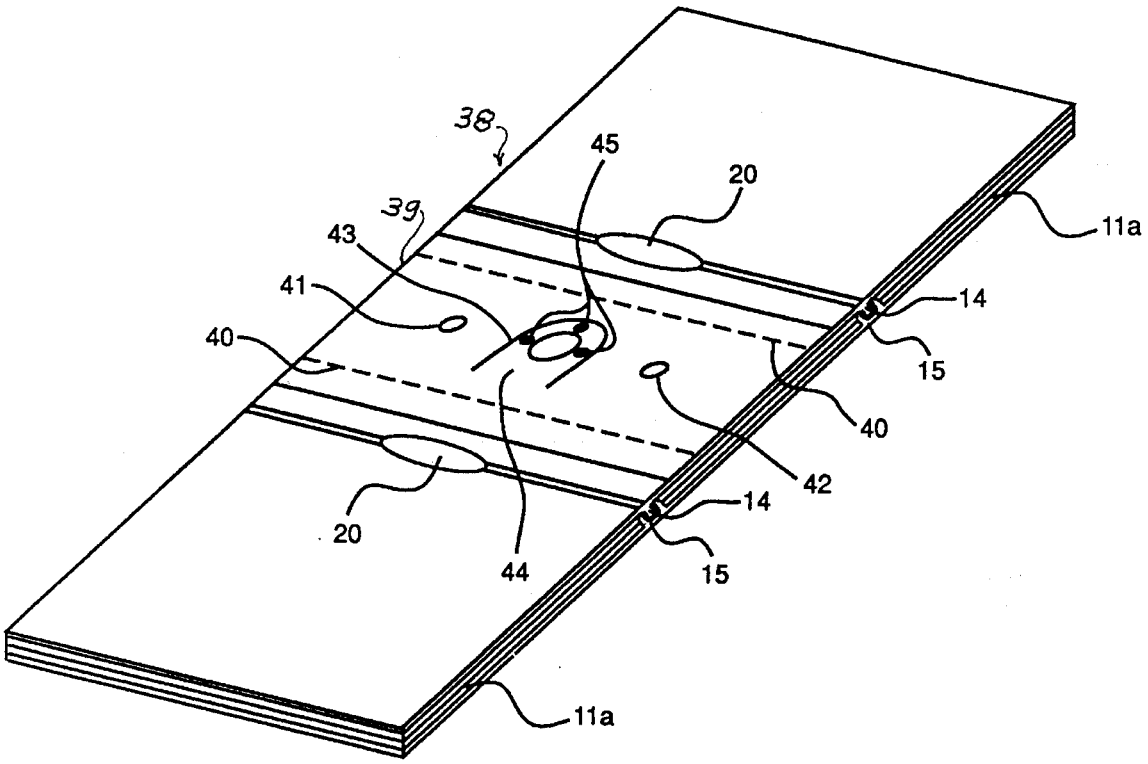
FIG. 12 shows the bags of the invention packaged as bundles of bags for use by a customer.

FIG. 12 shows a view of a stack 38 of bags such as 11A of the invention. A hanger 44 is formed on the header 39 of the bags of the stack. The hanger 44 is formed by cutting a semi-oval line 43 and a center hole 46 through the header. The headers 39 of each bag are tacked together by needle point heat seals 45. In use, the hanger 44 is bent out of the plane of the stack 38 and mounted on a suitable hook, not shown. Additional mounting holes 41 and 42 are also formed in each of the headers 39. Perforations 40 extending across each of the headers 39 permit the bags 11A to be separated from the stack 38 such as by the user.

While the invention has been particularly shown and described with reference to a preferred embodiment thereof, it will be understood by those skilled in the art, that various changes in form and detail can be made therein without departing from the spirit and scope of the invention.

We claim:

1. A recloseable plastic bag having a bottom, sides, sealed side edges, and a mouth comprising, a) engaging and mating profiles positioned on said sides adjacent and parallel to said mouth for closing said mouth when said profiles are engaged, b) a selected section of at least one of said profiles intermediate said side edges comprising a flattened non-engaging section to maintain a part of said mouth of said bag open, c) said selected non-engaging section enabling the remaining major portions of said profiles to be more readily disengaged to open said mouth by initiating a separating action starting at said non-engaging section, and d) said selected non-engaging section permitting any air in said bag to escape therethrough as said profiles are engaged when reclosing said bag.

2. A bag as in claim 1 wherein said section is in the range of one-half inch to one inch in length.

3. A bag as in claim 1 wherein said section is non-sealable to flowable materials.

4. A bag as in claim 1 further including a marker adjacent said section to indicate where the profiles should be separated.

5. A method of making plastic bags having mating profiles which are easy to open and easy to close consisting of the steps of:

a) making a bag having a mouth, a closed bottom, sides and sealed side edges, bag having mating profiles closed and engaged with each other and parallel to the mouth of said bag, and b) re-forming at least one of said profiles in a limited section intermediate said side edges of said bag to provide a non-engaging and non-sealed section between said profiles to enable easy opening of the profiles by initiating opening at said non-engaging section and enabling easy reclosing of said profiles by permitting any air captured in the bag to escape through said non-engaging section.

6. A method of forming closures comprising a pair of elongated recloseable mating profiles for plastic bags, said bags having a bottom, sides, a mouth, and said elongated recloseable mating profiles extending parallel to the mouth of the bag, said profiles being disengaged to open the mouth of the bag and being interlocked with each other to close the mouth of the bag, said method comprising the step of:

a) reforming a limited section of at least one of said profiles intermediate the ends of said profiles to provide a non-engaging section on at least one profile which prevents said profiles from engaging along said section.

7. A method of making bags as in claim 6 wherein said pair of profiles comprise a male and a females profile and said female profile is the profile re-formed to provide said non-engaging section.

* * * * *